United States Patent [19]

Hummert

[11] Patent Number: 4,844,152

[45] Date of Patent: Jul. 4, 1989

[54] STRUCTURAL PLUG MEMBER AND INSERT TOOL

[76] Inventor: Gerald F. Hummert, Spurta St., St. Libory, Ill. 62282

[21] Appl. No.: 92,656

[22] Filed: Sep. 3, 1987

[51] Int. Cl.[4] ..... F28F 11/02

[52] U.S. Cl. ..... 165/76; 138/89

[58] Field of Search ..... 165/76; 138/89; 220/234, 284; 86/29, 30

[56] References Cited

U.S. PATENT DOCUMENTS

| | | | |
|---|---|---|---|
| 730,378 | 6/1903 | Lambert | 138/89 |
| 791,351 | 5/1905 | Malloy | 138/89 |
| 1,837,345 | 12/1931 | Thomas | 138/89 X |
| 1,837,346 | 12/1931 | Thomas et al. | 138/89 X |
| 3,148,798 | 9/1964 | Brown | 220/42 |
| 4,046,168 | 9/1977 | Milne | 138/89 |
| 4,462,430 | 7/1984 | Anthony et al. | 138/89 |
| 4,470,437 | 9/1984 | Rabinovich | 138/89 X |
| 4,637,436 | 1/1987 | Stewart, Jr. et al. | 138/89 |
| 4,762,152 | 8/1988 | Clausen | 138/89 |

*Primary Examiner*—Martin P. Schwadron
*Assistant Examiner*—Allen J. Flanigan
*Attorney, Agent, or Firm*—Polster, Polster and Lucchesi

[57] ABSTRACT

A plug member and insertion tool arrangement for closing structural openings such as those in gas leaking tubes of a heat exchanger including an inverted cup-like plug member having a circular disc-like base portion with a cantilevering peripheral wall portion extending therefrom and an insertion tool to releasably support, guide and insert the plug member.

11 Claims, 1 Drawing Sheet

STRUCTURAL PLUG MEMBER AND INSERT TOOL

BACKGROUND OF THE INVENTION

The present invention relates to structural plug members and more particularly to a unique and novel plug member for heat exchanger tube openings and a unique and novel tool member combined therewith.

It is well known in the structural arts to utilize plug members to close openings therewith and any number of plug members have been designed to accomplish this. For example, attention is directed to U.S. Pat. No. 3,889,841, issued to W. H. Edmonds on June 17, 1975, which patent teaches a cupped freeze plug having an open-ended base closed by an elastomer material bonded within the cup. Further, in heat exchangers, it is generally well known to selectively close leaking and/or corroded heat exchange tubes with metallic plug members similar to those used in the plumbing art. These past plug members have been comparatively heavy, expensive to manufacture and difficult to manipulate, assemble and monitor - often breaking away from their openings.

The present invention, recognizing the problems of the past, as well as the causes which have given rise to such problems, provides a unique structural plug member that is particularly useful in selectively plugging often difficult to reach heat exchange tube openings. The plug member arrangement to the present invention is economical and straightforward in manufacture and assembly, requires a minimum of materials, is light in weight and is readily insertbile in fast sealing, compatible relation with preselected structural tube openings with a minimum of structural deterioration during heating operations. Further, the present invention provides in combination with such novel plug member arrangement a unique, readily assembled plug insertion tool which permits plug insertion in structural openings which might otherwise be difficult to reach.

Various other features of the present invention will become obvious to one skilled in the art upon reading the disclosure set forth herein.

SUMMARY OF THE INVENTION

More particularly the present invention provides a plug member for a structural opening comprising: a base portion; and, a holding portion integral with and extending in cantilever fashion from the base portion, the holding portion being sized and conforming with the structural opening to engage in fast wedge nesting relation therewith whereby the base portion covers the opening. In addition the present invention provides in combination with a plug member, an insert tool comprising: a tool body having one end sized to releasably conform in male-female nesting relation with one end of the plug member; and, a coupling fixture at the other end of the tool body to matingly receive a coupling fixture at at least one end of a manipulating pole for the tool body.

It is to be understood that various changes can be made by one skilled in the art in one or more of the several parts of the inventive arrangement disclosed herein without departing from the scope or spirit of the present invention. For example, in the plug member, both the base and cantilevered holding portions could be modified relative each other and with respect to the structural opening and insertion tool respectively without departing from the basic features of the present invention. Similarly, the insertion tool could be modified relative the inventive plug member and the manipulating pole without departing from the basic features of the present invention.

BRIEF DESCRIPTION OF THE DRAWINGS

Referring to the drawings which disclose one advantageous embodiment of the unique plug member and insertion tool therefor.

DETAILED DESCRIPTION OF THE DRAWINGS

Figure 1:
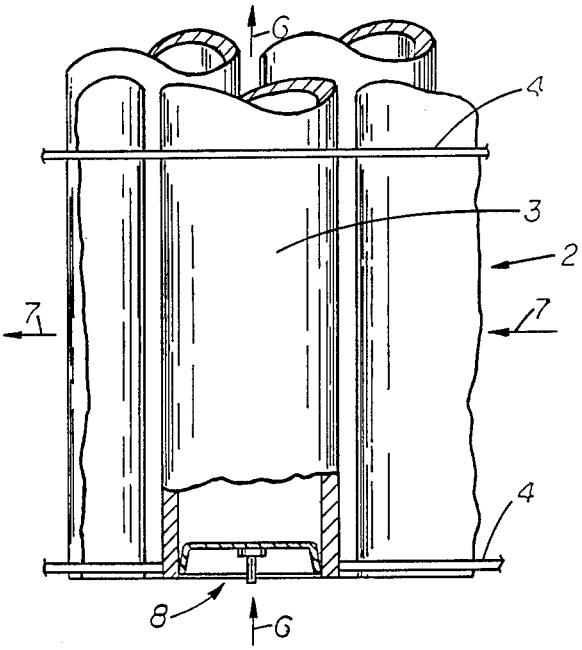
FIG. 1 is a partial broken away vertical view of a portion of a typical heat exchanger utilized in a power station, the arrows showing flow direction of gas and air with one tube broken away to illustrate an inventive plug member inserted therein.

Referring to FIG. 1 of the drawings, there is disclosed a portion of a typical heat exchanger 2 including a gang of open-ended spaced cylindrical metallic tubes 3 supported by spaced header plates in a suitable plenum associated with a power station (not shown). The hot gas stream, represented by arrows 6, ordinarily flows into a plenum and through tubes 3 of heat exchanger 2. The air stream to be heated, represented by arrows 7 flows into the same plenum around spaced tubes 3 of heat exchanger 2 to be heated thereby. Occasionally one or more of these tubes erodes and cracks, allowing the hot gas stream 6 passing therethrough to mix with the air stream 7 to be heated. Suitable records of these eroded tubes can be maintained by monitoring operating personnel and when the situation warrants, eroded tubes are blocked or plugged without a serious loss in the efficiency of heat exchanger 2.

To accomplish this blocking or plugging in an efficient, straightforward manner with a minimum of subsequent breaking away of the plugs from the sealed tubes due to heat variations, each of the eroded tubes 3 to be closed off can be provided with an inventive inverted, cup-like plug member 8.

Figure 3:
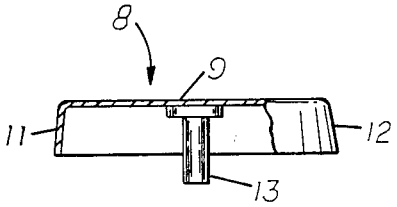
FIG. 3 is a cross-sectional side view of the plug member of FIG. 2; and, FIG. 4 is a cross-sectional side view of the insertion tool of FIG. 2.

Each plug member 8 (FIGS. 2 and 3) advantageously can be formed from a suitably thin, corrosive resistant, slightly flexible material having a coefficient of expansion compatible with the coefficient of expansion of tubes 3—such as an aluminum or a thin stainless steel material—to permit the plug to expand and contract with the tube with which it is associated to thus minimize separation. Each plug member 8 includes a base portion 9 in the form of a flat circular disc which is sized and shaped to conform with and freely clear the internal diameters of tubes 3 to permit free insertion of inverted cup-like plug member 8 through the openings of the tubes. Integral with and extending outwardly in cantilevered fashion from base portion 9 in holding portion 11 in the form of a cantilevered peripheral wall. It is to be noted that the outer face or surface of wall can be provided with a suitable knurl or gripping pattern 12 to further ensure a fast relation between a tube to be blocked and the wall 11 nestingly wedged into the opening thereof. It is to be understood, however, that the unique construction of holding portion 11 can be sufficient for a proper operation of plug 8 without knurling. It further is to be noted that each base portion 9 advantageously is provided with a centrally positioned fixed, cylindrical guide post 13 extending normally therefrom to be surrounded by peripheral circular wall 11. In the embodiment disclosed, post 13 is disclosed to have a length slightly greater than the depth of cantilevered wall 11 but it is to be understood that other lengths and shapes can be used.

Figure 2:
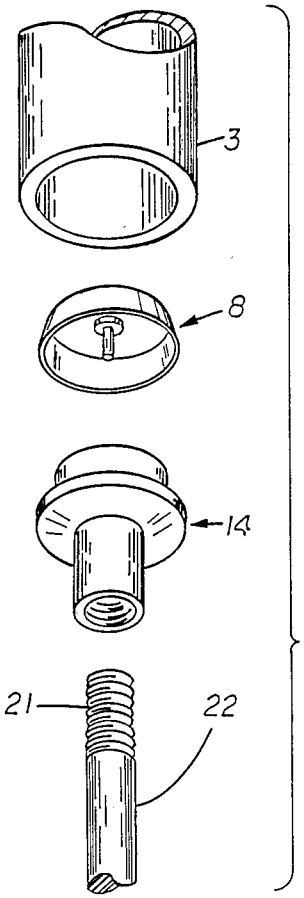
FIG. 2 is an enlarged, partially broken away exploded isometric view of a tube to be closed, the inventive plug member, and the inventive insertion tool combined therewith.
Figure 4:
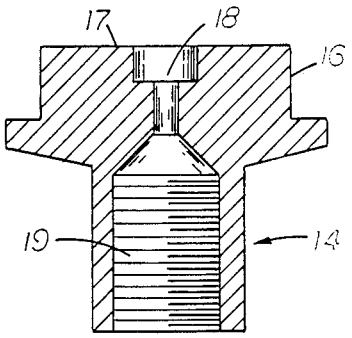

Referring to FIGS. 2 and 4 of the drawings, the inventive assembly or plug insert tool 14, which can be efficiently employed in combination with any one of a plurality of plug members 8, is disclosed. Tool 14, which can be formed from a number of suitable materials such as 304 stainless steel, includes a body 16 having a flat circular disc portion 17 sized and shaped to conform with the flat circular disc portion 9 of plug member 8. Centrally positioned within disc portion 17 is an aperture 18 sized and shaped to readily accommodate guide post 13 extending from base portion 9 of a plug member 8. Thus, a plug member 8 with its peripheral wall holding portion 11 freely surrounding disc portion 18 of tool 14 can be releasably supported for wedge nesting insertion into a preselected tube opening. In this regard, it is to be noted that disc portion 17 is selectively dimensioned to accommodate peripheral wall 11. It is further to be noted that the opposite end of body 16 of insert tool 14 is provided with a threaded female socket 19. Socket 19 serves to receive in male-female coupling arrangement the male threaded extremity 21 at at least one end of a manipulation pole 22 which can be utilized with tool 14 in difficult to reach places.

It is further to be understood that in some situations it is desirable to insert plug 8 from one or more of the upper ends of tubes 3, rather than from the lower ends thereof. In accordance with another feature of the present invention and as can be seen in FIG. 4 of the drawings, to accomplish this, plug insert tool 14 can be provided with a suitable releasable gripping means to retain a plug 8 supported thereon when the insert tool 14 is inverted, or in other words held in an upside down position from that position as shown in FIG. 4. A spring loaded ball assembly 25 can be provided to extend radially of the longitudinal axis of aperture 18 with a small portion of the ball yieldingly protruding into the aperture 18 to provide sufficient yieldable friction or pressure against the side wall of post 13 when inserted into the aperture to hold plug 8 in a supported position on tool 14 when the tool is inverted and yet permit plug 8 to disengage from tool 14 when plug 8 has been approximately wedged into a tube.

From the description herein, it can be seen that a unique and novel arrangement of a plug member and insertion tool is provided for structural openings of tubes to be sealed as a situation might require.

The invention claimed is:

1. A plug member for inserting fully into a structural opening of a tube and into sealing engagement with the tube wall comprising:

a fluid impervious base portion; and, a fluid impervious holding portion integral with and extending in cantilever fashion from said base portion, said holding portion extending outwardly at an angle other than normal to said base portion to permit centering and yielding snug engagement in said structural opening of said tube, said holding portion being sufficiently flexible to permit elastic, radially inward deformation upon insertion into said structural opening and being sized and conforming with said structural opening to engage in fast wedge nesting and sealing relation with said tube wall at a preselected position therealong.

2. The plug member of claim 1, the material thereof having a preselected coefficient of expansion conforming with the coefficient of expansion of the tube wall.

3. The plug member of claim 1, the material thereof being corrosion resistant.

4. The plug member of claim 1, said holding portion including knurls on the outer face thereof to enhance fast nesting of said plug member with said tube wall.

5. The plug member of claim 1, sais base portion having a guide post extending therefrom to enhance centering and nesting insertion of said plug member through said structural opening of said tube.

6. The plug member of claim 1, and an insert tool sized and conforming with said holding portion to releasably support said plug member for nesting engagement with and through said structural opening of said tube.

7. The plug member of claim 1, said base portion being in the form of a flat circular disc sized to conform with and freely clear the internal diameter of a heat exchanger tube opening with said holding portion including a wall extending outwardly at an angle from the periphery of said flat circular disc to engage in snug nesting relation with said heat exchanger tube wall in inverted cup-like relation therewith.

8. The plug member of claim 1, said base portion being in the form of a flat circular disc preselectively sized to conform with and freely clear the internal diameter of a heat exchanger tube opening with said holding portion including a peripheral wall extending outwardly at an angle from the periphery of said flat circular disc to engage in snug wedge nesting relation with said heat exchanger tube wall in inverted cup-like relation therewith, said flat circular disc of said base portion having a central male guide post member extending normally therefrom to be surrounded by said peripheral wall; and an insert tool including a flat circular disc portion at one end thereof conforming with the flat circular disc portion of said plug member with a central female aperture therein to receive said central guide post member to allow said insert tool to releasably support said plug member for wedge nesting engagement with said heat exchanger tube wall.

9. The plug member of claim 8, said insert tool including a coupling fixture at the other end thereof to matingly engage with a coupling fixture at the end of a manipulating pole member.

10. The plug member of claim 8, said insert tool including releasable gripping means cooperatively mounted adjacent said central female aperture to provide sufficient yieldable pressure to hold said guide post member of said plug in inserted position when said tool is inverted and to release said guide post when said plug member has been inserted into wedge position with a support opening.

11. In a heat exchanger including a gang of open-ended cylindrical, metallic tubes through which a first gas stream internally passes to be in heat exchange relation with a second gas stream flowing externally around said cylindrical tubes, plug members for inserting fully into leaking tubes preselectively blocking off such leaking tubes with each plug member comprising:

a flat circular fluid impervious disc sized to conform with and freely clear the internal diameters of said cylindrical tube openings, said disc having a peripheral circular fluid impervious disc wall integral therewith and extending outwardly in cantilever fashion at an angle therefrom to engage in snug nesting relation in inverted cup-like and sealing relation with one of said tubes at a preselected position along the inner wall thereof, said integral disc and disc wall being formed from a corrosion resistant steel alloy having a coefficient of expansion conforming with the coefficient of expansion of said tubes, said disc wall including knurls on the outer surface thereof to enhance fast nesting and sealing relation with one of said tube walls and said flat circular disc having a centrally positioned guide post extending normally therefrom to be surrounded by said circular disc wall; and, an insert tool for said plug members, said tool including at one end thereof a flat circular disc sized and shaped to conform with said flat circular disc of a plug member and having a centrally positioned aperture to accommodatingly receive said centrally positioned guide post member to allow said insert tool to releasably support said plug member to pass through a tube opening for nesting and sealing engagement with said tube wall at a preselected position therealong, said tool including a threaded socket at the opposite end thereof to receive in male-female relation the male threaded end of a manipulating pole member.

* * * * *